United States Patent [19]

Britch

[11] 4,298,218

[45] Nov. 3, 1981

[54] LATCHING ASSEMBLY FOR RISER PIPE SPACERS

[75] Inventor: James A. Britch, Westwego, La.

[73] Assignee: Standard Oil Company (Indiana), Chicago, Ill.

[21] Appl. No.: 70,944

[22] Filed: Aug. 30, 1979

[51] Int. Cl.[3] ..... F16L 35/00

[52] U.S. Cl. ..... 285/3; 285/24; 285/85; 285/317; 285/423

[58] Field of Search ..... 285/24, 39, 27, 85, 285/18, 91, 317, 423; 166/338, 340, 366, 367; 248/125, 408, 409; 405/168, 169; 403/325, 328, 322

[56] References Cited

U.S. PATENT DOCUMENTS

| | | | |
|---|---|---|---|
| 3,073,142 | 1/1963 | Beers | 403/328 X |
| 3,171,674 | 3/1965 | Bickel et al. | 285/39 |
| 3,645,563 | 2/1972 | Rochelle | 285/317 X |
| 3,648,638 | 3/1972 | Blenkarn | 405/202 X |
| 3,978,804 | 9/1976 | Beynet et al. | 114/123 X |
| 4,198,179 | 4/1980 | Pease | 405/145 |

*Primary Examiner*—Dave W. Arola
*Attorney, Agent, or Firm*—John D. Gassett

[57] ABSTRACT

Means are provided for latching a Vertically Moored Platform riser spacer to the riser pipes which connect a floating platform to a subsea anchor. This includes a spring loaded latch pin recessed in a hole in the riser donut housing which surrounds the riser and which is released by pulling a spring loaded latch release pin to let the latch pin move outwardly to a latched position where it is held in this position by a spring loaded shear pin. To disengage the latch pin, a hydraulic ram or other means can be used to shear the retaining pins and remove the latch pin.

5 Claims, 5 Drawing Figures

LATCHING ASSEMBLY FOR RISER PIPE SPACERS

BACKGROUND OF THE INVENTION

1. Field of the Invention

This invention relates to a structure floating on a body of water. More particularly, the invention relates to a floating structure from which drilling or producing operations concerning oil and gas are carried out. In more specific aspects, the invention concerns a floating structure having buoyancy means for supporting the structure and anchored to an ocean floor by parallel elongated members such as riser pipes.

2. Setting of the Invention

In recent years there has been considerable attention attracted to the drilling and production of wells located in water. Wells may be drilled in the ocean floor from either fixed platform in relatively shallow water or from floating structures or vessels in deeper water. In deeper water, it is common practice to drill from a floating structure. In recent years, there has been attention directed toward many different kinds of floating structures from which underwater wells can be drilled. One such drilling structure is referred to as the Vertically Moored Platform and is described in U.S. Pat. No. 3,648,638, issued Mar. 14, 1972, Kenneth A. Blenkarn, inventor. In the Vertically Moored Platform, a structure is supported from the surface of the water by buoyant members. The buoyant members are connected to anchors in the floor of the body of water by elongated leg members which are parallel. These leg members are most commonly large diameter; e.g., 20 inches, and are called riser pipes.

PRIOR ART

This relates very closely to U.S. Pat. No. 3,978,804 "Riser Spacers for Vertically Moored Platform", inventors Pierre A. Beynet and David A. Dixon, issued Sept. 7, 1976. That patent shows a Vertically Moored Platform anchored to the ocean floor at each corner of a typically rectangular shaped floating platform. Each leg is composed of a plurality of elongated riser pipes. That patent teaches to provide spacers at various vertical intervals along the length of each leg to keep the riser pipes from moving with respect to each other to the extent that one leg or pipe would damage another. Another purpose is to force the individually tensioned risers to have a fundamental natural frequency of lateral vibrations which is higher than the highest anticipated frequency due to vortex shedding.

BRIEF DESCRIPTION OF THE INVENTION

This invention relates to a method and apparatus of anchoring a floating offshore structure such as the Vertically Moored Platform at a selected location in a body of water. An anchor means is provided at the bottom of the water at the selected location. Then a plurality of parallel spaced legs connect the offshore floating structure with the anchor means. The floating structure is frequently in the shape of a rectangle and has a leg at each corner. Each leg consists of a plurality of parallel riser pipes under tension. As taught in U.S. Pat. No. 3,978,804, one should provide a plurality of spacing or centralizing means at vertically spaced interval for several purposes, including: (1) to hold elongated members or riser pipes in a fixed position with respect to each other at the level at which the spacing means is provided, and (2) to cause the risers to have a natural frequency different from the flutter frequency. The present invention concerns a novel means of latching the spacer means to the riser pipes. A riser pipe donut or donut housing is fixed to the riser pipe at the level at which it is desired to place the spacers. This riser donut carries a latch pin which is capable of extending beyond the donut when released from the surface. The extended pin supports the riser spacers at the correct location.

Various objects and a better understanding of the invention can be had from the following description taken in conjunction with the drawings.

DETAILED DESCRIPTION OF THE INVENTION

Figure 1:
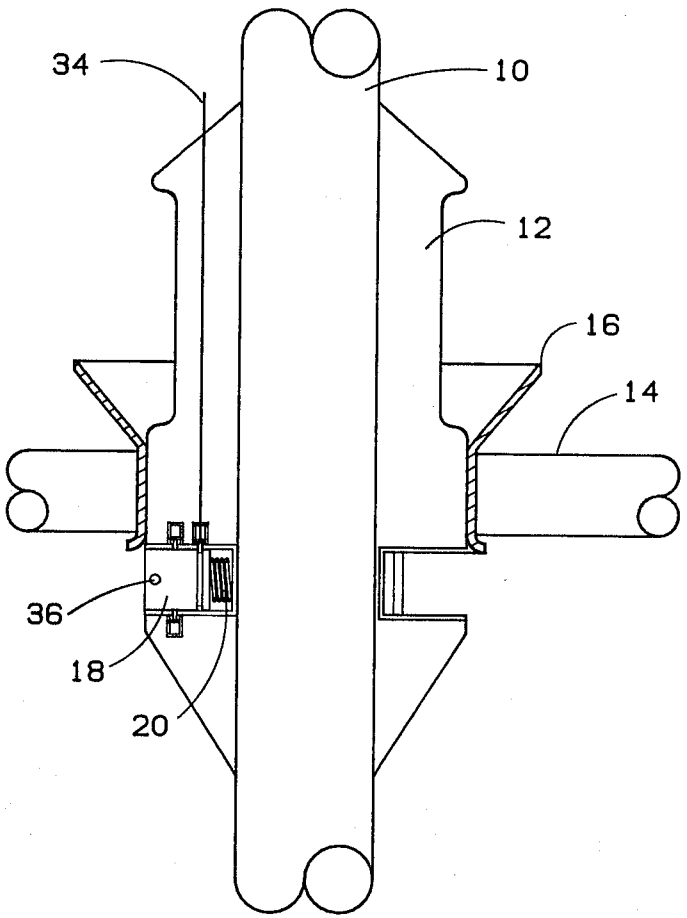
FIG. 1 illustrates a riser pipe provided with a riser donut carrying a latching mechanism.

Attention is first directed to FIG. 1 which shows a riser pipe 10 having a riser donut or riser donut housing 12 thereon. Riser pipe 10 can correspond, for example, to riser pipe 22 of said U.S. Pat. No. 3,978,804. It is preferred that riser donut 12 be made of an epoxy or other nonelectrical conductive material and molded directly to the riser pipe 10 and may take the shape shown in FIG. 1. This electrical insulation is essential for corrosion protection systems. Also shown is a portion of a spacer frame 14 having a funnel 16 for riser pipe 10 and donut 12. Riser spacer frame 14 can typically be such as that described in said U.S. Pat. No. 3,978,804, although various types of riser spacers can be used. A latch pin 18 is provided in riser donut 12, and when in its relaxed retracted position, donut 12 and riser pipe 10 can pass freely through the opening within funnel 16 of spacer 14. Latch pin 18 is in latch slot 20 in the riser donut 12.

Figure 2:
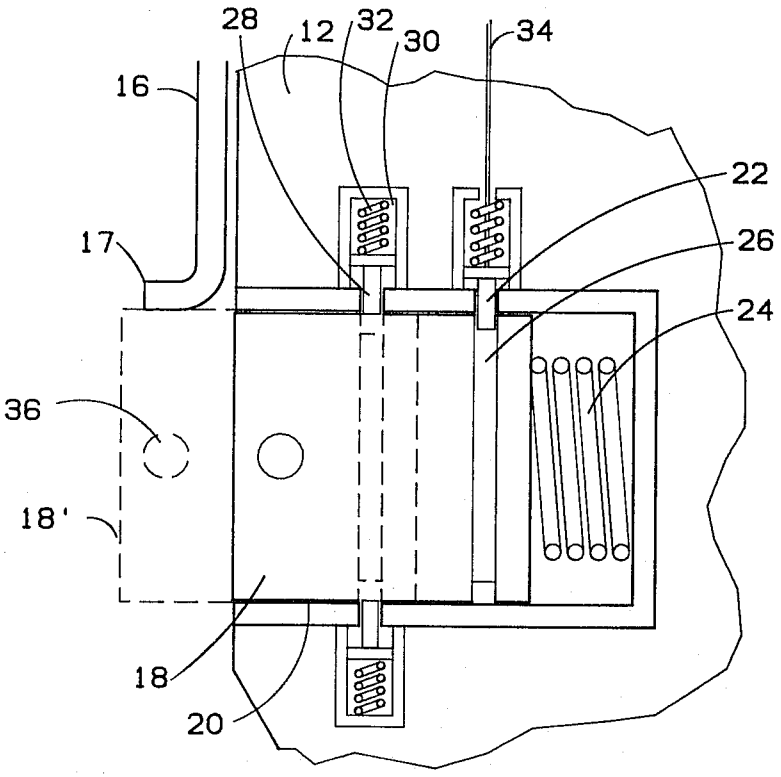
FIG. 2 is an enlarged view of the latching device of FIG. 1.

Attention is directed to FIG. 2 which shows an enlarged and detailed view of the latch pin of FIG. 1. Shown thereon is latch pin 18 in its retracted position and held there by release pin 22. A large spring 24 is shown compressed and has an outwardly directed force on latch pin 18.

Latch pin 18 is held in position by spring loaded release pin 22 which extends into circumferential groove 26 of the pin 22. In the device of FIG. 2, shear pins 28 are held in holes 30 of donut 12 and are biased toward slot 20 by springs 32. When it is desired to actuate latch pin 18 so that it extends out under lip 17 of spacer 16, all that is necessary to do is pull release 22 from groove 26. This can be accomplished by pulling on line 34. Other means of releasing it such as by pressure or electrical or mechanical means actuated at the surface can be used. Once release pin 22 is pulled out of groove 26, spring 24 shoves latch pin 18 to the position indicated by dotted lines 18'. When in this position, shear pins 28 are extended by springs 32 into groove 26 which is now aligned with the shear pins 28. This shear pin 28 is used to retain the latch pin in the extended position. Hole 36 is provided in pin 18 for removal of latch pin 18 if it should ever become necessary. This could be performed by a diver type procedure using a hydraulic ram or other type jack for supplying sufficient force to shear pins 28. Shear pins 28 would have sufficient shear strength to resist outwardly force of spring 24 but still be low enough for easy removal of latch pin 18.

Figure 4:
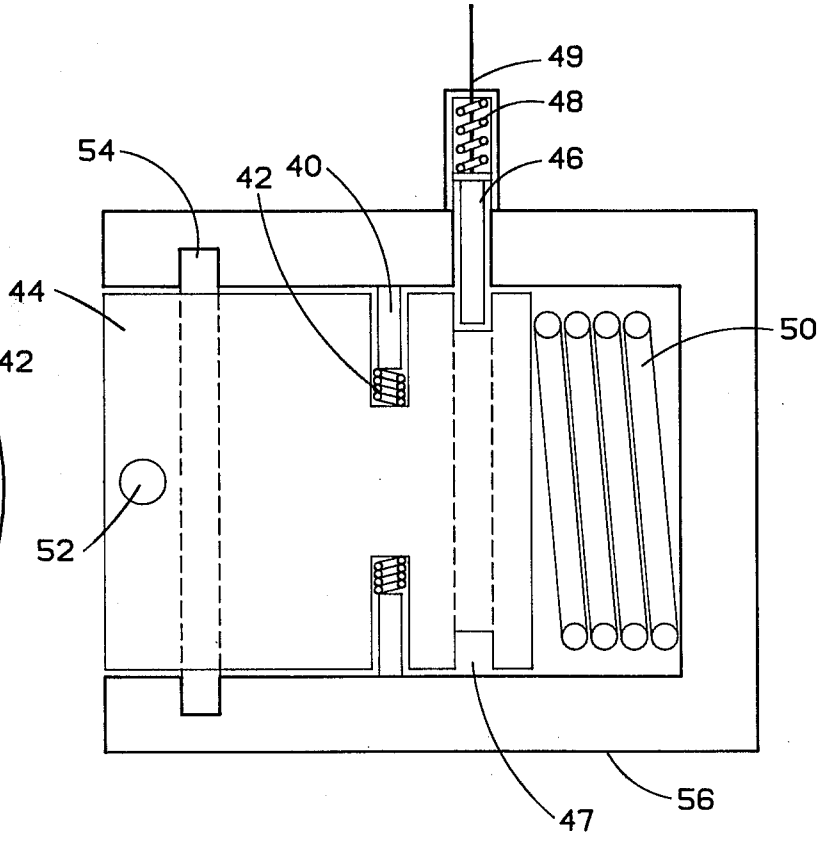
FIG. 4 is a section taken along the line 4—4 of FIG. 3 and shows the latch in its retracted position.
Figure 3:
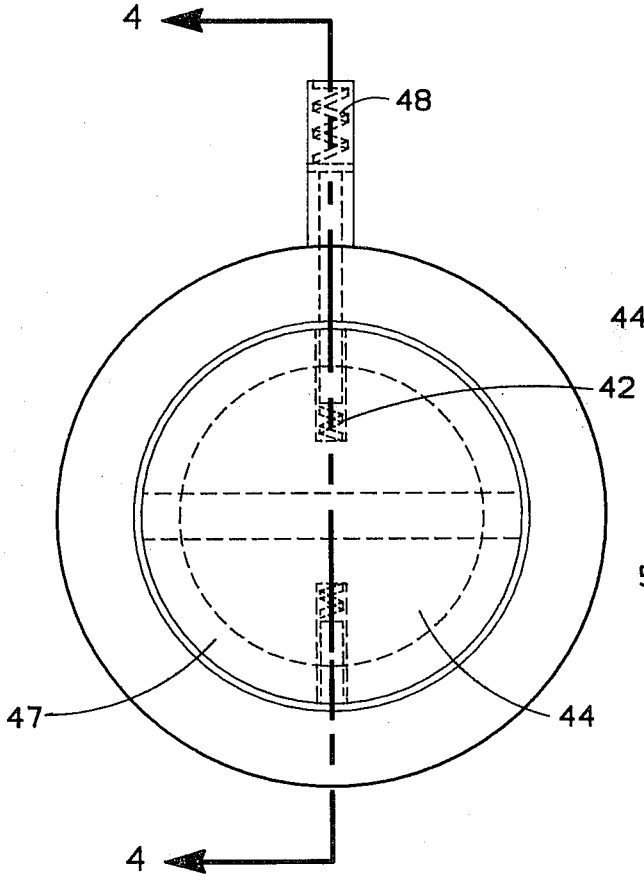
FIG. 3 is an end view of a different embodiment of the latching means.
Figure 5:
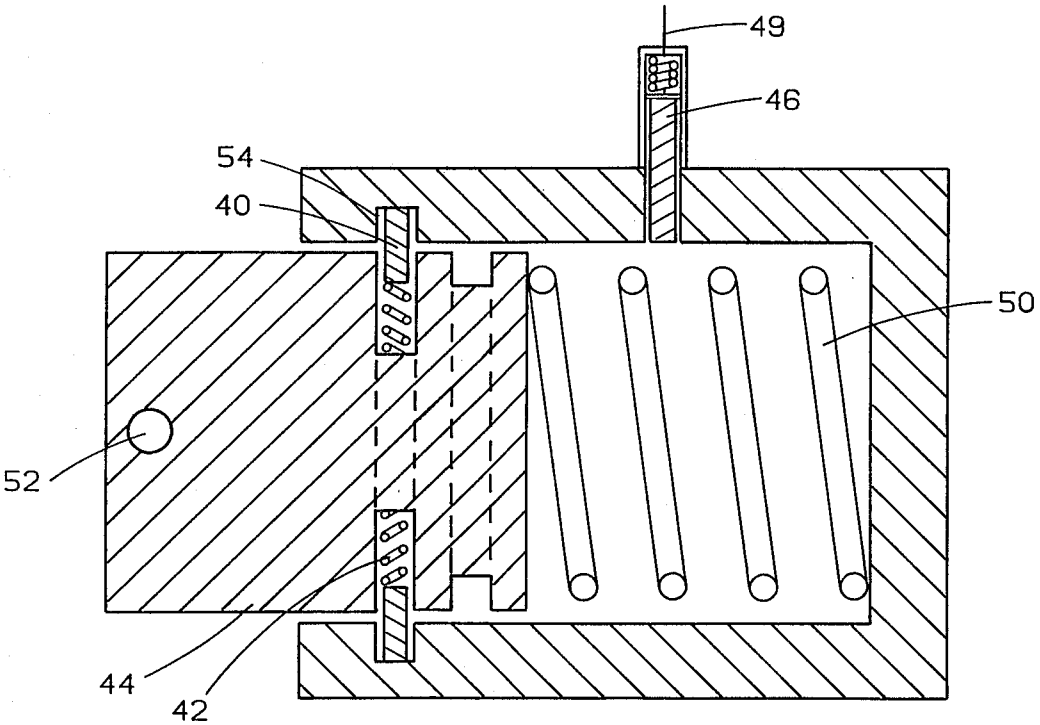
FIG. 5 is similar to FIG. 4 except that it shows the retaining pin in its extended position.

Attention is next directed to FIGS. 3 and 4 which illustrate a modification of the device of FIGS. 1 and 2. The main modification is that in the device in FIGS. 3 and 4, the shear pins are located within the latch pin and not in the riser donut as they are in FIGS. 1 and 2. As shown in FIGS. 3 and 4, shear pins 40 are urged outwardly by springs 42. Latch pin 44 is held in position by release pin 46 which is urged downwardly by springs 48 into groove 47 of latch housing 56. A spring 50 urges latch pin 44 in its outward or left position. Latch pin 44 is also provided with a hole 52 which serves the same function as hole 36 of FIG. 2. Retaining grooves 54 have been provided in the wall of latch housing 56 which is a part of riser donut 12. Latch pin 44 can be released in the same manner as described above in regard to FIGS. 1 and 2. Release pin 46 is removed from groove 47 by pulling on line 49 and spring 50 forces pin 44 to its furthermost position until shear pins 40 enter retainer grooves 54. This position is illustrated in FIG. 5.

While the above description has been made in detail, various modifications can be made thereto without departing from the spirit or scope of the invention.

What is claimed is:

1. A latching means for use with a riser pipe connecting a subsea well and floating structure which comprises:

a donut housing placed about said riser pipe and attached thereto;

at least one hole in said donut housing opening to the exterior thereof and being perpendicular to the axis of the riser pipe about which the donut housing is placed;

a latch pin in said hole and having a latching recess;

a spring in said hole urging said latch pin outwardly away from said riser pipe toward a position wherein the outer end of said latch pin extends beyond said donut housing;

a release pin extending from said donut housing into said latching recess of said latch pin to hold said latch pin in position;

shear pin means limiting the outward movement of said latch pin when said releasing pin is released to hold said latch pin in a fixed position with respect to said donut housing.

2. A latching means as defined in claim 1 wherein said shear pin means includes a retainer groove within said riser donut housing opening into said hole and shear pins positioned in and carried within said latch pin and biased outwardly and means to remotely remove said release pin from said latching recess.

3. A latching means as defined in claim 1 in which said shear pin means includes a circumferential groove in the outer surface of said latch pin and inwardly biased shear pins positioned in holes within said donut housing and biased inwardly toward said hole and means to remotely remove said release pin from said latching recess.

4. A latching means as defined in claims 1, 2 or 3, wherein said donut housing is made of a non-electric conductive material and said spring is electrically insulated from said riser pipe.

5. A latching means as defined in claims 1, 2 or 3, wherein said donut housing is made of an epoxy molded directly to said riser pipe.

* * * * *